United States Patent [19]

Carlson

[11] 3,958,289

[45] May 25, 1976

[54] CANOE STORAGE COMPARTMENT

[76] Inventor: Arthur A. Carlson, Suite 210, Plymouth Court Office Center, 12805 Hwy. 55, Plymouth Village, Minn. 55441

[22] Filed: Aug. 5, 1974

[21] Appl. No.: 495,036

[52] U.S. Cl. ..... 9/1.7; 9/1.1

[51] Int. Cl.[2] ..... B63B 27/00

[58] Field of Search ..... 9/1 R, 3, 1 D, 6.5, 9/7; 24/221 K

[56] References Cited

UNITED STATES PATENTS

| | | | |
|---|---|---|---|
| 906,261 | 12/1908 | Morzinski | 9/1 R |
| 1,172,974 | 2/1916 | Frayser | 9/1 R |
| 2,203,565 | 6/1940 | Field | 9/1 R |
| 3,035,283 | 5/1962 | Mott | 9/3 |
| 3,189,965 | 6/1965 | Parsons | 24/221 K |
| 3,649,977 | 3/1972 | Grabenauer | 9/3 |

*Primary Examiner*—Trygve M. Blix
*Assistant Examiner*—Stuart M. Goldstein
*Attorney, Agent, or Firm*—Keith B. Davis

[57] ABSTRACT

A storage compartment having a geometry permitting acceptance of the compartment within a canoe, having an opening for introduction and removal of articles into and from the compartment, having a door, moveable relative to said opening between closed and open positions, having door fastner means for securing said door in a closed position to close said compartment; and having means for attaching said compartment to a canoe.

15 Claims, 7 Drawing Figures

FIG. 1
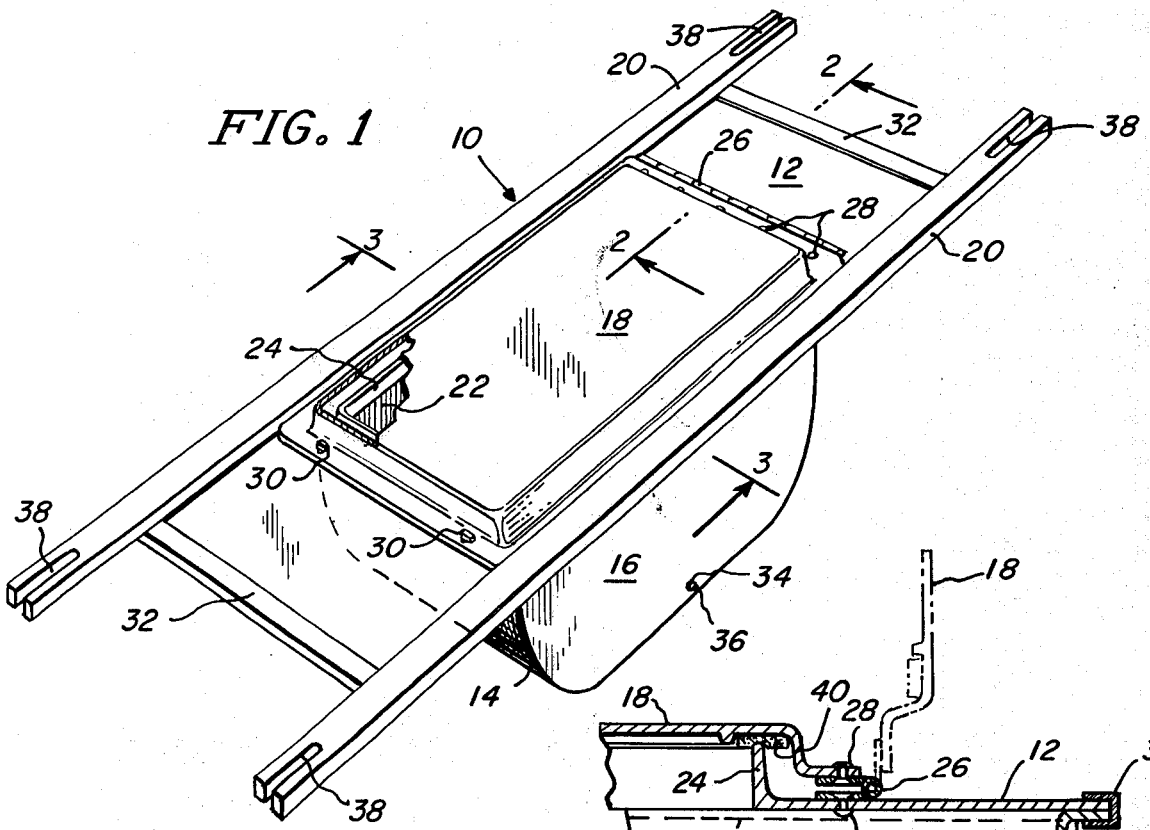
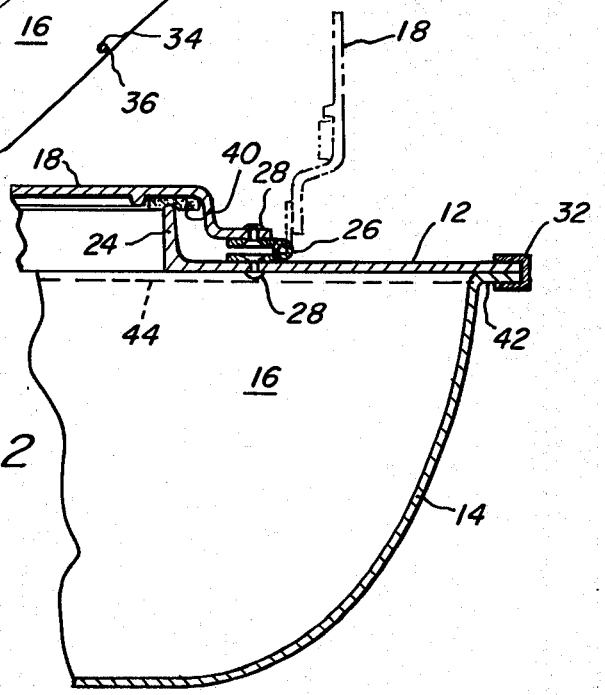
FIG. 2
FIG 3
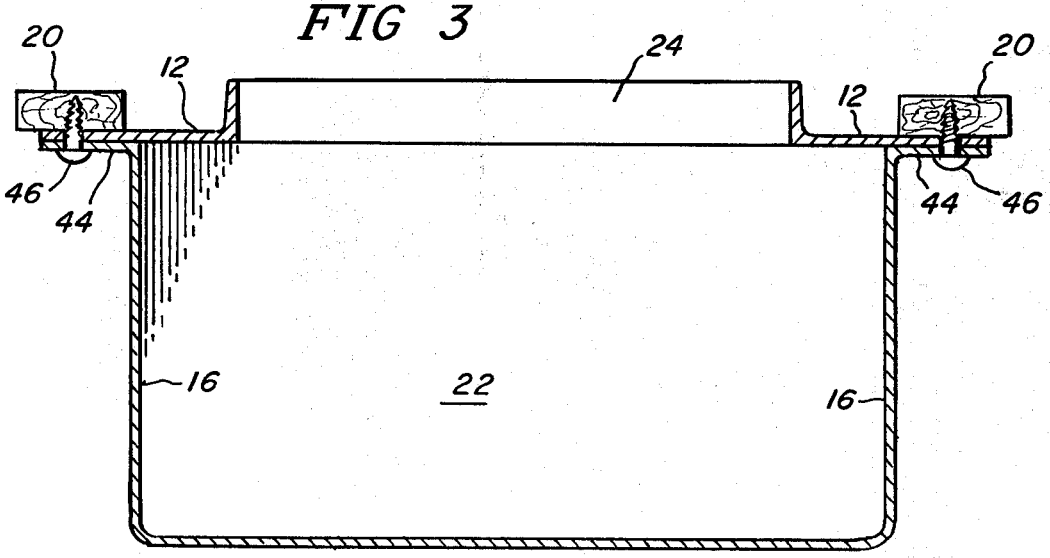

FIG. 5
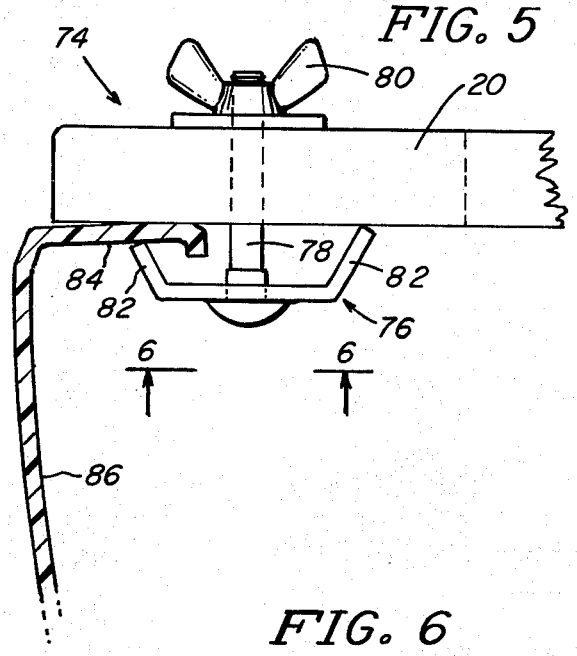
FIG. 4
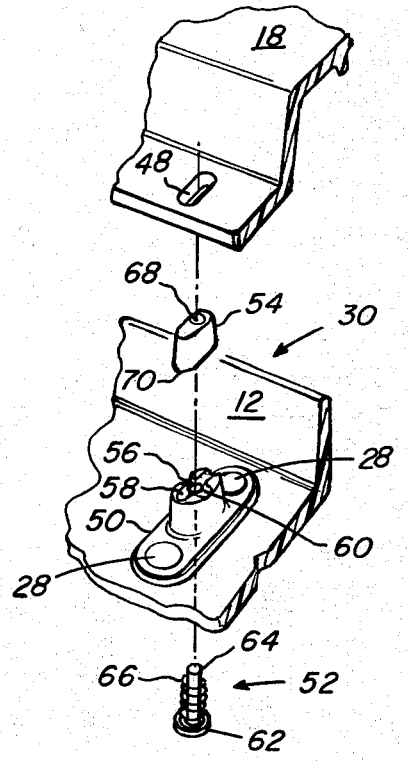
FIG. 6
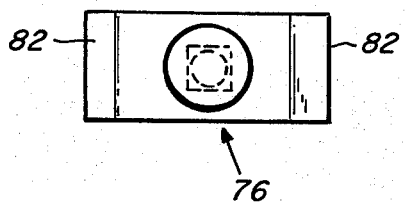
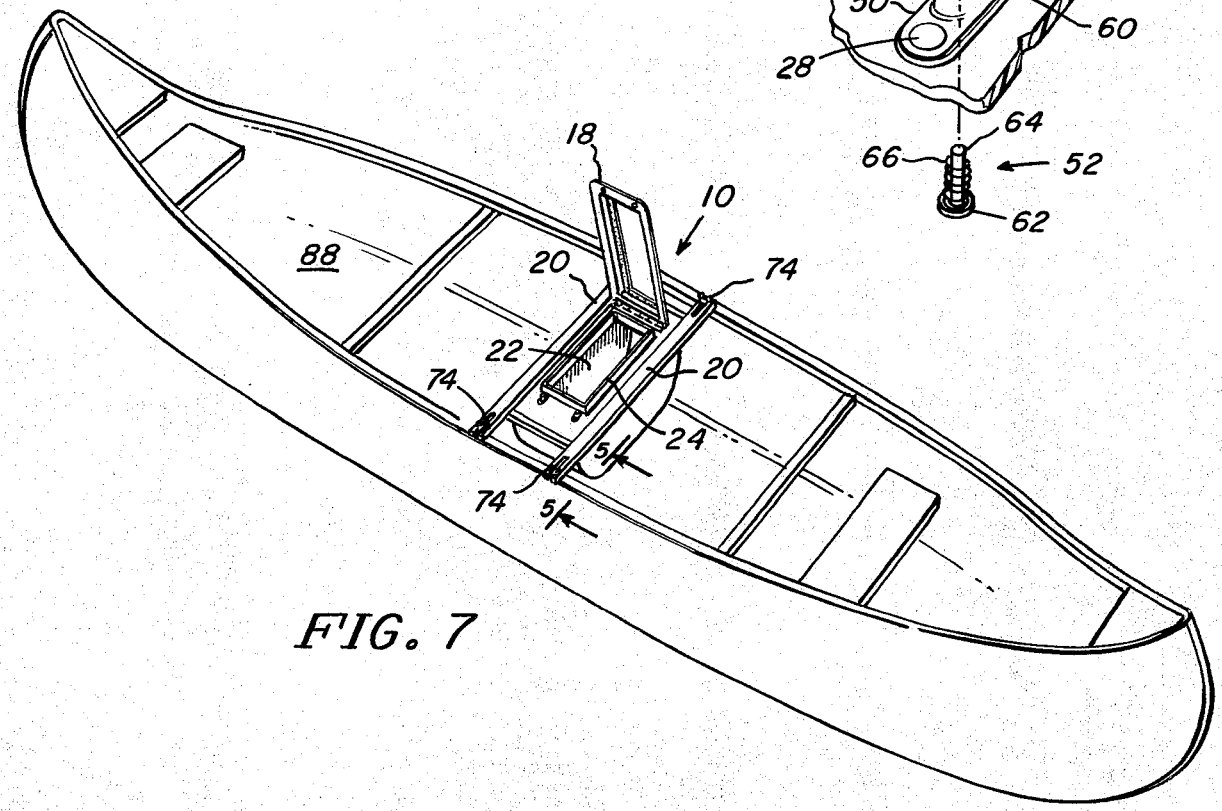
FIG. 7

CANOE STORAGE COMPARTMENT

BACKGROUND and FIELD of INVENTION

Briefly, this invention relates to that class of marine vessel popularly known as a canoe.

An object of the invention is to provide a storage compartment for a canoe for holding articles which otherwise would be subject to movement within a canoe.

Another object of the invention is to provide a water tight storage compartment for a canoe to both provide additional flotation for the canoe and to protect articles within the compartment from contact with water.

An additional object of the invention is to provide a portable storage compartment for a canoe to facilitate loading and unloading of the compartment away from the canoe when that is convenient and to permit removal of the compartment and use of the canoe without the compartment when desired.

A further object of the invention is to provide a storage compartment having a drain plug for removal of fluid such as melted ice cubes from the compartment.

BRIEF DESCRIPTION OF INVENTION

Briefly, the invention comprises a storage compartment for a canoe. The compartment geometry permits acceptance of the compartment within a canoe, and preferably approximately conforms with a cross-section of the canoe geometry. The compartment includes an opening for introduction and removal of articles into and from the compartment. The compartment also includes a door moveable between open and closed positions and a fastener for securing said door in a closed position to close said compartment.

BRIEF DESCRIPTION OF DRAWINGS

FIG. 1 is a perspective view of a canoe storage compartment according to the present invention;

FIG. 2 is a sectional view of a compartment taken along line 2—2 of FIG. 1;

FIG. 3 is a sectional view of a compartment taken along line 3—3 of FIG. 1;

FIG. 4 is an exploded view of a door fastener of the compartment of FIG. 1 shown in relation to the door and top of the compartment;

FIG. 5 is a side view of a handle of a storage compartment and of the attachment means for securing a compartment to a canoe taken along lines 5—5 of FIG. 7;

FIG. 6 is a bottom view of the attachment means of FIG. 5; and

FIG. 7 is a perspective view illustrating a storage compartment secured to a canoe.

DETAILED DESCRIPTION OF INVENTION

Referring now to FIG. 1, a storage compartment according to a preferred embodiment of the invention is shown generally as 10. Compartment 10 comprises a top section 12, a combination ends and bottom section 14, pair of side sections 16 only one of which is visible in FIG. 1, a door 18 which is partially cut-away in FIG. 1 and a pair of combination reinforcements and handles 20. Top section 12 includes an opening 22 and a neck 24 around the opening. Door 18 is generally pan shaped and is fixedly attached to top section 12 with piano hinge 26 by means of pop-rivets 28. Door 18 is releasably secured to top section 12 by a pair of door fasteners 30. The top 12 and combination ends and bottom section 14 are secured across their ends by U-shaped channels 32. The visible side section 16, as does the other side section 16, conforms in shape to and encloses a periphery of the combination ends and bottom section 14. One side section 16 includes a drain opening 34 and drain plug 36. Handles 20 include slots 38 for fastening the storage compartment 10 to a canoe.

FIG. 2 is a sectional view taken along line 2—2 of FIG. 1, which more clearly illustrates the neck 24 of top 12, pan-shape of door 18, manner of interconnection of combination ends and bottom section 14, and top 12, by U-shaped channel 32, as well as the profile of storage compartment 10 defined by top section 12 and combination ends and bottom section 14. FIG. 2 also illustrates that door 18 includes a gasket 40 positioned to contact neck 24 upon closing of the door. With door 18 closed gasket 40 is in compression to form a watertight seal between door 18 and neck 24. As shown, interconnection of and a watertight seal between top 12 and combination ends and bottom section 14 by channel 32 is facilitated by a lip 42 of said section 14. Side section 16 also includes a lip 44 which similarly facilitates a watertight seal. The edge of lip 44 is in phantom in FIG. 2.

The lips 44 of sides 16 and the joining of side 16, top 12 and combination reinforcements and handles 20 are more clearly shown in FIG. 3 a sectional view taken along lines 3—3 of FIG. 1. Self tapping screws 46 penetrate through lip 44 of side 16 and top 12 and penetrate into handles 20. The overlap of lip 44 and top 12 permit of a watertight seal between the sides 16 and top 12.

FIG. 4 is an exploded view, shown with reference to door 18 and top 12, of a door fastener 30 employed in the preferred embodiment to secure the door in a closed position. Door fastener 30 comprises a base 50, spring loaded plunger 52, and finger operable grip 54. Base 50 is elongated and is hollow to accept plunger 52 and includes aperture 56 and a pair of orthogonal recesses 58 and 60. Plunger 52 includes a head 62, a shaft 64 and a spring 66. The diameter of spring 66 is greater than the diameter of aperture 54. The length of grip 54 corresponds to the length of the longer of the recesses, recess 58. Grip 54 includes an aperture 68 for accepting shaft 64 of plunger 52 and includes a beveled edge 70 conforming with the cross section of recesses 58 and 60. Grip 54 is elongate and conforms generally to a similar elongate but slightly larger elongate opening 48 in door 18. A fastener 30 is assembled by passing shaft 64 of plunger 52 through aperture 56 of base 50 and aperture 68 of grip 54. The end of shaft 64 extending through grip 54 is peaned or otherwise spread to form base 50, plunger 52 and grip 54 into a unitary assembly. Shaft 64 is selected in length such that when so assembled, spring 66 is in compression. Grip 54 has two stable orientations, the two orientations corresponding to alignment with recesses 58 and 60. In a stable orientation, beveled edge 70 seats in a recess, in recess 58 in an open orientation, and in recess 60 in a closed orientation.

A variety of well known methods and materials may be employed in the manufacture of a storage compartment according to the preferred embodiment illustrated in FIG. 1, including from linear polyethylene materials by the process of rotational molding, which materials and process are both well known, and from aluminum by processes such as stretching or die-stamping. Storage compartments according to the preferred embodiment of FIG. 1 have been manufactured using fiber glass materials by the process known in the art as hand lay up. According to such a method, a previously constructed mold of each part (top 12, combination ends — bottom section 14, side door 16 and door 18) was coated with a release agent such as No. 1 Brazillian Carnauba wax and covered by hand with fiber glass mat. A 1½ ounce mat has been found appropriate for producing storage compartments of 40 to 50 quarts capacity. Fiber glass polyester resin promoted with a catalyst was applied until the mat was filled and built up to about ⅛ inch thickness and air bubbles were removed by rolling with a steel roller. This structure was allowed to cure at room temperature about 2 hours, after which the parts were extracted from the mold and piano hinge 26 pop riveted to top 12 and door 18 and door fasteners 30 similarly pop riveted to top 12. Further assembly of the individual parts comprised coating lips 42 and 44 with polyestr resin and catalyst and clamping top 12 to lips 42 and 44 under from 500 to 1,000 pounds per square inch of pressure for about 2 hours. Channels 32 were similarly fused to top 12 and lip 42 with polyester resin and catalyst. A closed cell neoprene self adhering gasket 40 of material such as that commonly known as weatherstripping was affixed to the inside of door 18 and drain plug 36 inserted. Combination reinforcements and handles 20 of ¾ × 1⅝ inch oak were attached using self tapping screws 46 to complete the structure.

Referring now to FIG. 5, means for and the manner of securing a storage compartment 10 to a canoe are illustrated. A clamp attachment means 74 comprises a head 76, shaft 78, and nut 80. The shaft 78 passes through the slot 38 of combination reinforcement handle 20 and head 76 bridges slot 20. Head 76 is generally dish shaped having upturned edges 82 which grip and deform to provide compression when nut 80 is drawn tight. Head 76 is positioned so one upturned edge 82 engages a gunnel 84 of the side of a canoe 86 between the edge 82 and the underside of combination reinforcement handle 20; the other edge 82 bites into combination reinforcement handle 20 to secure the compartment 10 to the canoe.

FIG. 6 is a bottom view of clamp 74 taken along line 6—6 of FIG. 5. As shown, head 76 for the illustrated preferred embodiment has a generally rectangular configuration.

A perspective view of a storage compartment 10 secured in a canoe is shown in FIG. 7. Each of the four handles of combination reinforcements and handles 20 are secured to the gunnels 84 of a canoe 88 by clamp attachment means 74. Door 18 is shown in an open position to fully illustrate opening 22 and neck 24.

It will be appreciated that a canoe, particularly a fibre glass canoe, can be modified to include attachment means for accepting and holding the compartment to eliminate the need for attachment means on the compartment itself. For example, an extra rib can be added to the canoe so that a compartment is sandwiched between two ribs. Or, mating ribs and slots can be respectively molded into the canoe and the compartment.

The following materials have been employed to make the foregoing described embodiment;

| | | |
|---|---|---|
| fiber glass mat | — | 1-1/2 ounce, such as Owens-Corning M710; |

-continued

| | | |
|---|---|---|
| resin | — | 42% styrene laminating resin such as that manufactured by Cook Paint and Varnish Company, their part No. 939-x300 |
| catalyst | — | 60% methyl ethyl keotone peroxide in Di-Methyl Phthialate such as that manufactured by the Lucidol Division of Penn Wall Corp. under the trade name of Luper-Sol |
| reinforcement handles 20 | — | 3/4 inch by 1-5/8 inch oak |
| hinge 26 | — | cut to length from a 72 inch standard length No. 2, 1-1/4 inch wide by 0.040 thick stainless steel piano hinge; |
| fastener 30 | — | curtain fastener, such as nickel plated No. 994 manufactured by Perkins Marine Lamp and Hardware Corp. of Miami, Florida; |
| channel 32 | — | extruded aluminum channel such as die No. 597, No. 60-63TS, Vincent Brass and Aluminum Co., Minneapolis, Minnesota |
| drain plug 36 | — | 5/8 inch grommet, such as a No. 801 sold by Moller Manufacturing of Greenville, Mississippi; |
| Gasket 40 | — | 1 × 5/16 inch closed cell neoprene stripping carrying a pressure sensitive adhesive thereon, such as that marketed by Durable Rubber Products, Chicago, Illinois; |
| self tapping screw 46 | — | No. 10 × 3/4 inch, slotted, flat head, type A, cadmium, available from the Pheoll Manufacturing Company, Minneapolis, Minnesota |
| clamp 74 | — | 1/4 inch by 2 inch cadmium plated carriage bolt forced into a 5/16 inch diameter hole in a 1/8 inch thick by 1-3/16 by 3-9/16 inch piece of aluminum and a cadmium plated flat washer and wing nut. |

It is to be understood that the foregoing preferred embodiment is given by way of illustration and not by limitation and that variations and modifications of the foregoing fall within the scope of the present invention, the true scope of which is as set forth in the following claims.

What is claimed is:

1. For a canoe, a storage compartment comprising:

A. a compartment of a geometry permitting acceptance of the compartment within a canoe and having an opening of sufficient size for introduction into and removal from the compartment of various articles;

B. a door moveable between positions respectively permitting and preventing introduction into and removal from the compartment of said various articles;

C. door fastener means for securing said door to close said compartment; and,

D. attachment means permitting securement of the compartment to a canoe including at least a pair of opposing handles disposed to be perpendicular to the horizontal axis of a canoe and to extend transversely between the gunnels thereof above and across the full top of the compartment and each of which handles is adapted for attachment to a side of a canoe.

2. For a canoe, a storage compartment according to claim 1 wherein said compartment comprises;

a top section having said opening therein and having a pair of ends;

a combination ends and bottom section continuous between the ends of said top section to form opposing peripheries which define the profile of said compartment; and a pair of side sections each enclosing a said periphery to complete said compartment.

3. For a canoe, a storage compartment according to claim 2 wherein said top section includes a neck around said opening.

4. For a canoe, a storage compartment according to claim 3 wherein said door is pan shaped and hinged to the top so that the door closes upon said neck like an inverted pan.

5. For a canoe, a storage compartment according to claim 4 wherein said door includes a gasket positioned to contact said neck upon closing of the door and for compression to form a watertight seal when said door is fastened in a closed position.

6. For a canoe, a storage compartment according to claim 5 wherein said compartment includes a drain opening and corresponding drain plug to facilitate removal of fluids from said compartment.

7. For a canoe, a storage compartment according to claim 4 wherein said compartment includes a drain opening and corresponding drain plug to facilitate removal of fluids from said compartment.

8. For a canoe, a storage compartment according to claim 4 wherein said door fastener includes a generally elongate rotatable grip and said door includes a generally elongate aperture conforming in geometry with, slightly larger than, but sufficiently close in size to said grip that upon insertion of the grip through said aperture and rotation of said grip the door is securely fastened.

9. For a canoe, a storage compartment according to claim 2 wherein said compartment includes a drain opening and corresponding drain plug to facilitate removal of fluids from said compartment.

10. For a canoe, a storage compartment according to claim 1 wherein said attachment means provides releasable attachment to a said canoe to provide a portable storage compartment.

11. For a canoe, a storage compartment according to claim 10 wherein each said handle includes a slot therein and said attachment means comprises a finger operable nut; and a bolt having a head large enough to bridge said slot and said canoe to hold an extension or part of said canoe in compression between one side of said handle when the bolt is inserted through the slot and said nut is drawn tight on said bolt.

12. For a canoe, a storage compartment according to claim 8 wherein said bolt head is dish-shaped whereby the up turned edges of said head can deform to provide compression and can provide gripping by biting into said canoe part or extension.

13. For a canoe, a storage compartment according to claim 1 wherein said compartment includes a drain opening and corresponding drain plug to facilitate removal of fluids from said compartment.

14. For a canoe, a storage compartment according to claim 1 wherein said compartment comprises a fibre glass structure.

15. For a canoe, a storage compartment according to claim 1 wherein said compartment comprises rotational molded linear polyethylene.

* * * * *